United States Patent [19]

Mills

[11] Patent Number: 4,587,830

[45] Date of Patent: May 13, 1986

[54] PUNCH PRESS WITH QUICK-CHANGE DIE SET

[76] Inventor: Charles E. Mills, Rte. 1, Box 48, Reeds, Mo. 64859

[21] Appl. No.: 755,601

[22] Filed: Jul. 15, 1985

[51] Int. Cl.[4] ..... B21J 7/46

[52] U.S. Cl. ..... 72/442; 72/481; 83/698

[58] Field of Search ..... 72/442, 481, 352; 83/698; 100/918

[56] References Cited

U.S. PATENT DOCUMENTS

| | | | |
|---|---|---|---|
| 3,075,416 | 1/1963 | Stuhldreher | 72/481 |
| 3,702,560 | 11/1972 | Weidel . | |
| 3,848,494 | 11/1974 | Gargrave | 83/698 |
| 3,881,344 | 5/1975 | Ducate . | |
| 3,908,500 | 9/1975 | Gargrave | 83/698 |
| 3,926,032 | 12/1975 | Brooks et al. | 72/448 |
| 3,982,458 | 9/1976 | Terasaka . | |
| 4,160,372 | 7/1979 | Bergman, et al. . | |
| 4,187,713 | 2/1980 | Fellner . | |
| 4,267,758 | 5/1981 | Muhr et al. . | |
| 4,274,332 | 6/1981 | Nakamura . | |

*Primary Examiner*—Leon Gilden

*Attorney, Agent, or Firm*—Dressler, Goldsmith, Shore, Sutker & Milnamow, Ltd.

[57] ABSTRACT

A punch press construction is disclosed which includes a die set which can be slidably removed from the frame of the press. The press includes a double-acting fluid actuator having a piston rod which extends downwardly through the upper portion of the generally inverted U-shaped press frame. The die set comprises upper and lower die plates, with the slidable mounting arrangement comprising a pair of inwardly opening receiving grooves for slidably receiving the opposite edge portions of the lower die plate, and a coupling arrangement for operatively connecting the upper die plate and the actuator piston rod for vertical reciprocal movement together attendant to slidable positioning of the die set within the press frame.

7 Claims, 4 Drawing Figures

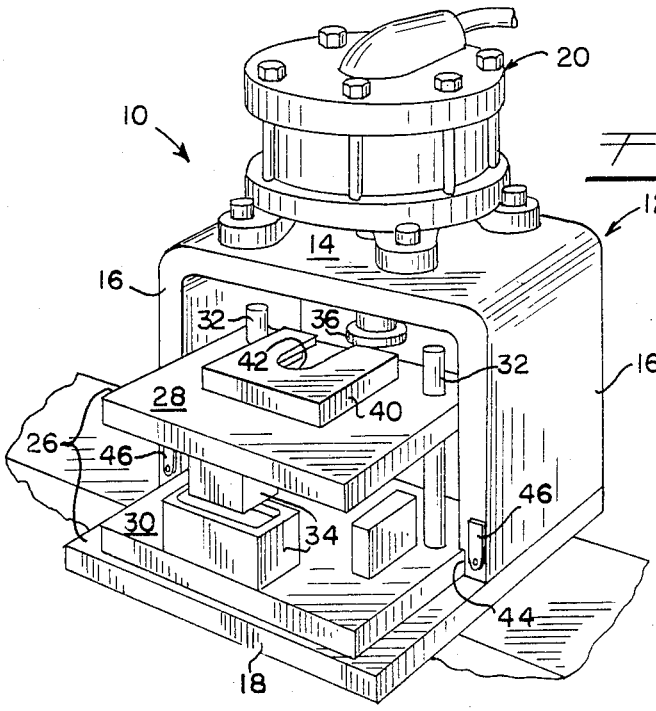
FIG. 1
FIG. 2
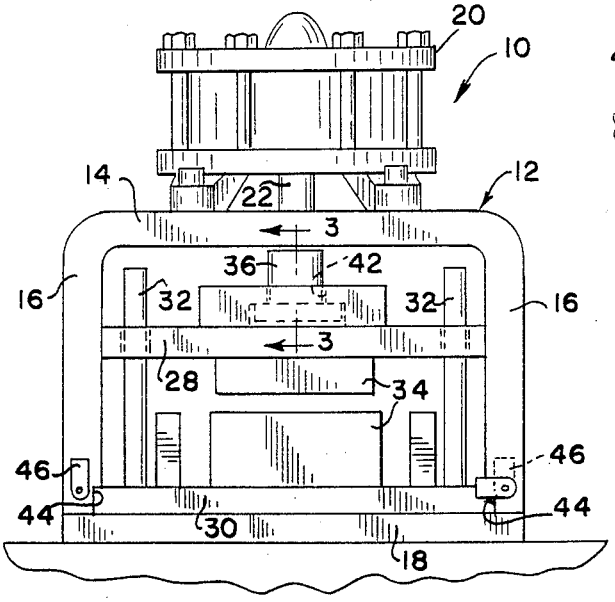
FIG. 3
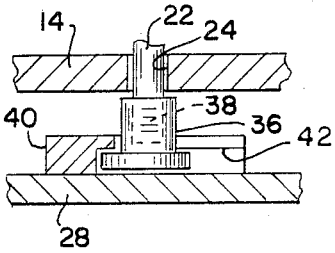
FIG. 4
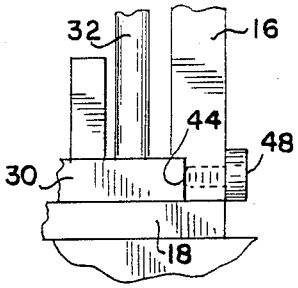

PUNCH PRESS WITH QUICK-CHANGE DIE SET

TECHNICAL FIELD

The present invention relates generally to material-forming punch press constructions, and more particularly to an improved punch press construction having a die set configured for very convenient slidable mounting in the press.

BACKGROUND OF THE INVENTION

Punch press devices are in widespread use for effecting stamping, punching, and like material-forming operations. One typical form of such a punch press includes a generally inverted U-shaped frame upon which is mounted a double-acting fluid actuator or ram (either pneumatic or hydraulic), with the piston rod of the actuator extending downwardly through the press frame for reciprocable vertical movement.

This type of punch press further includes a die set which typically comprises upper and lower die plates which carry cooperating material-forming die elements. The die set may include vertically oriented guide pins for maintaining the die plates in alignment during operation of the press. In operation, the lower die plate of the die set is usually held in fixed relation with respect to the press frame, while the upper die plate is operatively connected to the piston rod of the fluid actuator for reciprocable vertical movement relative to the lower plate.

As will be appreciated, it is frequently necessary to remove the die set of the punch press from the press frame, such as for inspection, maintenance, or replacement with another die set. In the past, replacement of the die set has been undesirably time-consuming, and usually entails at least partial disassembly of the press construction. Since a mechanical clamping mechanism is frequently employed for operatively connecting the piston rod of the fluid actuator with the upper die plate, die set removal requires loosening of the clamp mechanism and detachment of the upper die plate from the piston rod, with it being necessary to reverse the sequence of steps for installation of the same or different die set. Again, these various steps must be repeated whenever removal of the die set is required, thus undesirably detracting from the overall efficiency of the material-forming operation.

In view of the above, it will be recognized that a punch press construction which facilitates convenient and efficient die set removal and installation would be very desirable for enhancing the overall efficiency of punch press operations.

SUMMARY OF THE INVENTION

In accordance with the present invention, a punch press construction having a quick-change die set is disclosed which has been configured to promote very convenient die set removal and installation by a slidable mounting arrangement for the die set. In particular, the construction includes means for slidably mounting a lower die plate of the die set within the frame of the press, as well as means for slidably operatively connecting an upper die plate of the die set with a fluid actuator of the press.

The illustrated embodiment of the present punch press construction includes a generally inverted U-shaped frame having an upper frame web portion and a pair of spaced-apart frame leg portions depending from respective opposite sides of the upper frame portion. The press can further include a lower base plate upon which the frame leg portions are positioned.

The present construction further includes a double-acting fluid actuator or ram, which may be either pneumatically or hydraulically operated. The fluid actuator is mounted on the upper web portion of the press frame, with the actuator including a vertically reciprocable piston rod extending downwardly through the upper frame portion.

The present press construction further includes a removable die set positionable generally within the inverted U-shaped press frame. The die set may be of a typical integrated configuration, including an upper die plate and a lower die plate arranged in vertically spaced relation for relative vertical movement. The die plates are adapted to hold associated cooperating die elements between which material to be formed is positioned.

In accordance with the present invention, the present press construction further includes an arrangement for slidably mounting the die set in the press frame and for operatively connecting the actuator piston rod and the upper die plate, whereby operation of the double-acting actuator reciprocates the piston rod to vertically reciprocate the upper die plate relative to the lower die plate. To this end, the mounting arrangement includes a preferably generally inverted T-shaped coupling member threadably adjustably mounted on the lower end of the actuator piston rod, and a cavity-defining plate mounted on the upper die plate such that a rearwardly opening cavity is defined generally at the top of the upper die plate. The rearwardly opening cavity is preferably also of a generally inverted T-shaped configuration complemental to the coupling member such that the coupling memeber is slidably received in the cavity as the die set is slidably mounted in the press frame. As will be recognized, the preferred inverted T-shaped coupling member and cavity cooperate such that the upper die plate is operatively connected to the actuator piston rod for reciprocable vertical movement therewith.

Slidable mounting of the die set in the press frame is further achieved by the provision of a pair of inwardly opening receiving grooves defined by the pair of depending leg portions of the press frame, with the receiving grooves configured to slidably receive opposite edge portions of the lower die plate for fixing the lower die plate against vertical movement with respect to the press frame. It will be appreciated that by this desirably straightforward construction, the die set can very easily be slidably mounted in, or slidably removed from, the press frame, with the desired operative connection of the upper die plate and actuator piston rod effected without resort to mechanical clamp mechanisms or the like.

In the preferred embodiment, locking means are provided for releasably maintaining the opposite edge portions of the lower die plate in position within the receiving grooves of the press frame. In a presently preferred embodiment, one or more pivotal locking gates are provided for this purpose, with a locking gate mounted on at least one of the leg portions of the press frame. The locking gate is pivotally movable from a first generally upright position wherein the lower die plate is slidably movable in the receiving grooves, to a second generally lowered position wherein the locking gate prevents sliding movement of the lower die plate out of the receiving grooves after it has been positioned therein. In an alternate embodiment, the lower die plate is releasably maintained in the receiving grooves by at least one locking fastener threadably mounted in one of the frame leg portions for engagement with one of the side edges of the lower die plate.

Other features and advantages of the present invention will become readily apparent from the following detailed description, the appended claims, and the accompanying drawings.

BRIEF DESCRIPTION OF THE DRAWINGS

FIG. 1 is a front perspective view of a punch press construction having a quick-change die set embodying the principles of the present invention;

FIG. 2 is a front elevational view of the punch press construction shown in FIG. 1;

FIG. 3 is a partial cross-sectional view taken generally along line 3—3 of FIG. 2; and FIG. 4 is a partial front elevational view of the present punch press illustrating an alternate construction for releasably maintaining the die set of the press in an operative position.

DETAILED DESCRIPTION

While the present invention is susceptible of embodiment in various forms, there is shown in the drawings and will hereinafter be described presently preferred and alternate embodiments of the invention, with the understanding that the present disclosure is to be considered as an exemplification of the invention, and is not intended to limit the invention to the specific embodiment illustrated.

With reference now to the drawings, therein is illustrated a punch press construction 10 embodying the principles of the present invention. The press 10 includes a generally inverted U-shaped press frame 12 having an upper frame web portion 14 and a pair of frame leg portions 16 depending from respective opposite sides of upper frame portion 14. The press may further include a base plate 18 to which frame leg portions 16 are joined by suitable mechanical fasteners or the like.

Punch press 10 further includes a double-acting fluid actuator or ram 20 positioned on the upper frame portion 14 of the press frame. Actuator 20 is of a typical configuration, and may be either pneumatically or hydraulically operated. The actuator 20 includes an internally reciprocable piston having a piston rod 22 which extends from the lower end of the actuator through an opening 24 in upper frame portion 14 (see FIG. 3).

Punch press 10 further includes a slidably mountable die set, generally designated 26. Die set 26 is illustrated in a typical configuration comprising vertically spaced upper die plate 28 and lower die plate 30. The die set may include two or more vertically oriented guide pins 32 which extend between the upper and lower die plates, and maintain the die plates in alignment and in parallel relation attendant to relative movement therebetween. Die set 26 typically includes a pair of associated cooperating die elements 34 respectively carried by upper and lower die plates 28 and 30. Material to be formed is positioned between the die elements 34, with the upper of the die elements urged downwardly by operation of actuator 20 for forming the material.

As will be recognized, operation of punch press 10 requires that die plates 28 and 30 be moved relative to each other, i.e., that upper die plate 28 be vertically reciprocated by actuator 20 for movement relative to lower die plate 30. Thus, the upper die plate 28 must be operatively connected to actuator piston rod 22 for vertical reciprocation therewith.

As noted, punch press 10 is configured such that die set 26 can be slidably mounted within press frame 12, and to this end, the mounting arrangement includes means for operatively connecting upper die plate 28 and actuator piston rod 22 attendant to sliding disposition of die set 26 within press frame 12. The mounting arrangement includes a coupling member 36 mounted on the lower end of actuator piston rod 22. The coupling member 36 is preferably of a generally inverted T-shaped configuration, and is preferably joined to piston rod 22 by an adjustable threaded connection at 38 (see FIG. 3).

The operative connection between upper die plate 28 and piston rod 22 is further provided by means of a cavity-defining plate 40 fixed to upper die plate 28 with suitable mechanical fasteners or the like (not shown). Plate 40 is configured such that it defines a generally rearwardly opening cavity 42 which, as best illustrated in phantom line in FIG. 2, is of a generally inverted T-shaped configuration for slidably receiving the inverted T-shaped coupling member 36. Thus, attendant to sliding disposition of die set 26 in press frame 12, coupling member 36 is slidably received within the cavity 42, with upper die plate 28 and piston rod 22 thus operatively connected for reciprocable vertical movement together.

In order to further facilitate slidable mounting of die set 26 in press frame 12, and in order to hold lower die plate 30 in vertically fixed relation with respect to the press frame, the present punch press construction further includes a pair of inwardly opening receiving grooves 44 respectively defined by the lower ends of the depending frame leg portions 16. Receiving grooves 44 are configured to slidably receive opposite edge portions of lower die plate 30 and thereafter hold the lower die plate in vertically fixed relation with respect to the press frame. Thus, it will be appreciated that by the structure thus far described, die set 26 can be very conveniently slidably positioned within press frame 12, with sliding disposition of the die set in the frame effecting the desired operative connection between actuator piston rod 22 and upper die plate 28 for reciprocable vertical movement together.

In order to releasably maintain the die set 26 in position within press frame 12, the present construction further preferably includes means for releasably maintaining the lower die plate 30 in position within receiving grooves 44. In one embodiment of the present invention, the lower die plate 30 is releasably maintained in position within receiving grooves 44 by the provision of at least one pivotal locking gate 46 (two being illustrated) mounted on the frame leg portion 16 adjacent to the respective receiving groove 44. Each of the one or more locking gates 46 is pivotally movable from a first generally upright position wherein lower die plate 30 is slidably movable into and out of receiving grooves 44, to a second generally lowered position wherein the gate engages the front edge portion of lower die plate 30 and prevents its removal from receiving grooves 44 after it has been slidably positioned therein. Thus the locking gate holds the lower die plate 30, and therefore the entire die set 26, in position within press frame 12 and prevents dislodgement such as by vibration or the like attendant to operation of the punch press.

An alternate arrangement for maintaining lower die plate 30 in position within receiving grooves 44 is illustrated in FIG. 4, and comprises one or more locking fasteners 48 threadably mounted in at least one of the frame leg portions 16 adjacent to receiving groove 44 for engagement with the side edge of lower die plate 30. In this embodiment of the present invention, it is preferred that at least one of the locking fasteners 48 be provided in each of the frame leg portions 16 so that the fasteners can be urged into engagement with the opposite edge portions of the lower die plate 30, thus maintaining the lower die plate and the die set 26 in position within the press frame.

From the foregoing, it will be observed that numerous modifications and variations can be effected without departing from the true spirit and scope of the novel concept of the present invention. No limitation with respect to the specific embodiments illustrated herein is intended or should be inferred. It is, of course, intended to cover by the appended claims all such modifications as fall within the scope of the claims.

What is claimed is:

1. A punch press construcion, comprising:

a generally inverted U-shaped frame having an upper frame web portion and a pair of spaced apart frame leg portions depending from respective opposite sides of said upper frame portion;

double-acting fluid actuator mans mounted on said upper web portion of said frame, said actuator means including a vertically reciprocable actuator piston rod extending downwardly through said upper frame portion;

a die set positionable within said press frame, said die set comprising an upper die plate and a lower die plate arranged in vertically spaced relation for relative vertical movement, said die plates being adapted to hold associated cooperating die elements; and means for slidably mounting said die set in said press frame and for operatively connecting said actuator piston rod and said upper die plate whereby operation of said actuator means recipocates said piston rod to vertically reciprocate said upper die plate relative to said lower plate, said mounting means comprising coupling means mounted on the lower end of said actuator piston rod, and means defining a rearwardly opening cavity generally at the top of said upper die plate, said coupling means being slidably received in said cavity as said die set is slidably mounted in said press frame, said mounting means further comprising groove means defined by said pair of depending frame leg portions for slidably receiving opposite edge portions of said lower die plate and for holding said lower die plate against vertical movement with respect to said press frame.

2. A punch press construction in accordance with claim 1, including releasable means for releasably maintaining said opposite edge portions of said lower die plate in position within said groove means defined by said frame leg portions.

3. A punch press construction in accordance with claim 2, wherein said releasable means comprises movable locking gate means mounted on at least one of said frame leg portions, said gate means being movable from a first position wherein said lower die plate is slidably movable in said groove means, to a second position for preventing sliding movement of said lower die plate out of said groove means after said lower die plate has been slidably positioned therein.

4. A punch press construction in accordance with claim 2, wherein said releasable means comprises at least one locking fastener means threadably mounted in one of said frame leg portions for engagement with one of the side edges of said lower die plate to maintain said lower die plate in position within said groove means.

5. A punch press construction in accordance with claim 1, wherein said coupling means comprises a coupling member mounted on said piston rod and having a generally inverted T-shaped configuration, said cavity defined generally at the top of said upper die plate having a generally inverted T-shaped configuration for slidably receiving said inverted T-shaped coupling member for operatively connecting said piston rod and said upper die plate for reciprocable vertical movement together.

6. A punch press construcion, comprising:

a generally inverted U-shaped frame having an upper frame web portion and a pair of spaced apart frame leg portions depending from respective opposite sides of said upper frame portion;

double-acting fluid actuator means mounted on said upper web portion of said frame, said actuator means including a vertically reciprocable actuator piston rod extending downwardly through said upper frame portion;

a die set positionable within said press frame, said die set comprising an upper die plate and a lower die plate arranged in vertically spaced relation for relative vertical movement, said die plates being adapted to hold associated cooperating die elements;

means for slidably mounting said die set in said press frame and for operatively connecting said actuator piston rod and said upper die plate whereby operaton of said acturator means recipocates said piston rod to vertically reciprocate said upper die plate relative to said lower plate, said mounting means comprising coupling means having a generally inverted T-shaped configuration mounted on the lower end of said actuator piston rod, and cavity-defining plate means mounted on said upper die plate and defining a rearwardly opening cavity generally at the top of said upper die plate, said cavity having a generally inverted T-shaped configuration for slidably receiving said coupling means for operatively connecting said piston rod and said upper die plate for reciprocable vertical movement together, said coupling means being slidably received in said cavity as said die set is slidably mounted in said press frame, said mounting means further comprising a pair of inwardly opening receiving groove means respectively defined by lower ends of said pair of depending frame leg portions for respectively slidably receiving opposite edge portions of said lower die plate, and for holding said lower die plate against vertical movement with respect to said press frame; and means for releasably maintaining said opposite edge portions of said lower die plate in said receiving groove means.

7. A punch construction in accordance with claim 6, wherein said means for releasably maintaining comprises pivotal locking gate means mounted on at least one of said frame leg portions generally adjacent to the one of said receiving groove means defined thereby, said locking gate means being pivotally movable from a first generally upright position wherein said lower die plate is slidably movable in said groove means, to a second generally lowered position for preventing sliding movement of said lower die plate out of said groove means after said lower plate has been slidably positioned therein.

* * * * *